US005664595A

United States Patent [19]

Vonderhorst et al.

[11] Patent Number: 5,664,595

[45] Date of Patent: Sep. 9, 1997

[54] SCREEN APPARATUS POSITIONABLE ATOP AN UMBRELLA FOR TRANSPORTABLE PERSONAL PROTECTION FROM FLYING INSECTS

[76] Inventors: Eric John Vonderhorst; Frieda M. Vonderhorst, both of 1023 Guatay Ave., Chula Vista, Calif. 91911

[21] Appl. No.: 309,171

[22] Filed: Sep. 20, 1994

[51] Int. Cl.[6] ..... A45B 11/00

[52] U.S. Cl. ..... 135/16; 135/15.1; 135/90; 135/96; 135/98

[58] Field of Search ..... 135/90, 96, 98, 135/99, 16, 15.1, 87

[56] References Cited

U.S. PATENT DOCUMENTS

| | | | |
|---|---|---|---|
| 574,091 | 12/1896 | Irvine, Jr. | 135/98 X |
| 1,854,671 | 4/1932 | Roberts | 135/98 X |
| 2,221,366 | 11/1940 | Bisbing et al. | 135/98 X |
| 2,502,984 | 4/1950 | Parmenter | 135/16 X |
| 2,546,228 | 3/1951 | Martini | 135/16 |
| 2,943,634 | 7/1960 | Morgan | 135/98 X |
| 3,419,024 | 12/1968 | Hickerson, Jr. | 135/98 |
| 3,477,453 | 11/1969 | D'Ulisse et al. . | |
| 3,582,989 | 6/1971 | Fassbender . | |
| 3,860,022 | 1/1975 | Arndt et al. . | |
| 3,892,251 | 7/1975 | Warfield | 135/15.1 |
| 3,899,168 | 8/1975 | Besherse | 135/16 |
| 4,682,436 | 7/1987 | Ritson | 135/98 X |
| 5,172,712 | 12/1992 | Robinson . | |
| 5,184,865 | 2/1993 | Mohrashan et al. . | |

FOREIGN PATENT DOCUMENTS

| | | | |
|---|---|---|---|
| 0240975 | 8/1960 | Australia | 135/98 |
| 0592317 | 1/1934 | Germany | 135/98 |
| 3604853 | 8/1987 | Germany | 135/98 |
| 2060024 | 4/1981 | United Kingdom | 135/98 |

*Primary Examiner*—Wynn E. Wood

*Attorney, Agent, or Firm*—John Gugliotta; David P. Volk

[57] ABSTRACT

A stiff supportive covering with an attached net-like material that forms a tent-like enclosure for protection from flying insects when the stiff supportive covering is positioned atop a conventional umbrella in an open position and the net-like material is extended to the ground. The stiff supportive covering is preferably a circular-shaped plastic material and defines a relatively small circular opening permitting passage therethrough of the uppermost end of the conventional portable umbrella's supporting pole. The net-like material is attached about the circumference of the covering and has a length sufficient to extend to the ground. The net-like material has a plurality of weights attached at a lower edge thereby to retain the net-like material in contact with the ground. The net-like material may be rolled and secured atop the covering, thereby permitting the umbrella to be used without the tent-like enclosure while still maintaining the net-like material atop the umbrella for quick and easy unrolling thereof. Alternatively, the covering with the rolled and secured net-like material may be removed from atop the umbrella and stored or carried under one's arm or with a detachable carrying strap.

2 Claims, 4 Drawing Sheets

SCREEN APPARATUS POSITIONABLE ATOP AN UMBRELLA FOR TRANSPORTABLE PERSONAL PROTECTION FROM FLYING INSECTS

BACKGROUND OF THE INVENTION

1. Field of the Invention

The present invention relates generally to a shelter made of net-like material which is relatively impenetrable by flying insects, and, more particularly, to a shelter which provides portable personal protection from flying insects and which is transportable, particularly through a swarm of flying insects such as killer bees.

2. Description of the Related Art

The use of net-like material in combination with umbrellas to provide shelter from flying and other insects is known in the related art. For instance, U.S. Pat. No. 5,172,712, issued in the name of Robinson, discloses a combination beach umbrella and screen apparatus which includes a flexible screen which is detachably affixed around the perimeter of the shade portion, or covering, of the umbrella. In addition, U.S. Pat. No. 3,860,022, issued in the name of Arudt et al., discloses a portable shelter made from a net material that is to be used in combination with a roof comprising an extended umbrella-type structure, for protection from bugs and flying insects. Of particular interest is U.S. Pat. No. 3,477,453, issued in the name of D'Ulisse et al. That reference claims "means for securing the said sidewall sections to the ground." The heretofore known portable shelters of the related art have several disadvantages, among which are complicated structures and designs that are difficult to use interchangeably with various umbrellas having different sizes, and slow assembly resulting in lack of shelter in the event of an unexpected attack from a swarm of flying insects, such as killer bees. Another disadvantage with the related art is the restriction of movement to that movement within the invention which is affixed to the ground, thereby preventing movement through a swarm of flying insects, such as killer bees.

Consequently, a need has been felt for providing an apparatus and method which overcomes the problem of interchangability with umbrellas having different sizes, and the problem of slow assembly and subsequent restriction of movement to that movement within a shelter fixed to the ground in the event of an unexpected swarm of flying insects in general, and of an attack by a swarm of killer bees in particular.

SUMMARY OF THE INVENTION

It is therefore an object of the present invention to provide an improved screen apparatus which easily forms a tent-like enclosure when unrolled from a position atop an umbrella covering of a conventional portable umbrella in an open position.

It is a further object of the present invention to evenly distribute the weight of the screen apparatus about the support spokes which support the umbrella covering of a conventional portable umbrella in an open position.

It is a further object of the present invention to provide an improved screen apparatus that is not infringed by the ends of the support spokes which extend outwardly from the umbrella covering of a conventional portable umbrella in an open position.

It is a further object of the present invention to provide a screen apparatus which is interchangeably usable with various umbrellas having different sizes.

Briefly described according to one embodiment of the present invention, a stiff supportive covering, preferably a circular-shaped plastic material, defining a relatively small circular opening permitting passage therethrough of the uppermost end of the conventional portable umbrella's supporting pole has a net-like material attached about the circumference of the covering, wherein the net-like material has a length sufficient to extend to the ground, thereby to form a tent-like enclosure when the covering is positioned atop a conventional umbrella in an open position and the net-like material is extended to the ground. The net-like material has a plurality of weights attached at a lower edge thereby to retain the net-like material in contact with the ground. The net-like material may be rolled and secured atop the covering, thereby permitting the umbrella to be used without the tent-like enclosure while still maintaining the net-like material atop the umbrella for quick and easy unrolling thereof. Alternatively, the covering with the rolled and secured net-like material may be removed from atop the umbrella and stored or carried under one's arm or with a detachable carrying strap.

In accordance with a preferred embodiment, a screen apparatus is adapted to form a tent-like enclosure when positioned atop a conventional portable umbrella having a circular covering, which is supported by spokes extending outwardly from a central axis and thereby defining a spoke circumference, and an elongated supporting pole at the central axis which supports the spokes at a fixed distance above a carrying handle when the umbrella is being held in an open position above the ground, wherein the screen apparatus comprises: a supportive covering having a supportive covering circumference and defining a centrally-located relatively small circular opening permitting passage therethrough of the uppermost end of the elongated supporting pole, wherein the supportive covering is substantially rigid to evenly distribute the weight of the screen apparatus over the spokes; a rectangular piece of a net-like material having an upper edge, a lower edge, a first side edge and a second side edge, a length sufficient to circumvent the supportive covering circumference of the supportive covering and a with sufficient to span the distance between the supportive covering and the ground when the supportive covering is positioned atop the umbrella and the umbrella is being held in the open position, the upper edge being fixedly attached about the supportive covering circumference, the first side edge along its length being joined to the second side edge along its length, thereby defining a cylinder of net-like material about the supportive covering circumference; a plurality of weights fixedly attached at predetermined locations about the lower edge; wherein the lower edge with the plurality of weights is rollable toward the supportive covering and releasably securable atop the supportive covering for storage and subsequent rapid release for unrolling toward the ground to form the tent-like enclosure beneath the supportive covering for protection from flying insects.

An advantage of the present invention is that a rolled net-like material may be stored atop a conventional umbrella to be ready for quick unrolling and subsequent use for protection from insects in general and killer bees in particular.

Another advantage of the present invention is that a necessity to run from a bee swarm is eliminated, thereby preventing serious injury or death.

Another advantage of the present invention is that a user can carefully move through an area infested with insects while enclosed within the present invention.

Another advantage of the present invention is that affordable and full body protection is provided from insects, particularly killer bees.

Another advantage of the present invention is that medical costs and worker claims from insect bites and bee stings are minimized when one is protected by the present invention.

Another advantage of the present invention is that it is lightweight and portable, thereby making the present invention easy to carry, to use, and to store.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
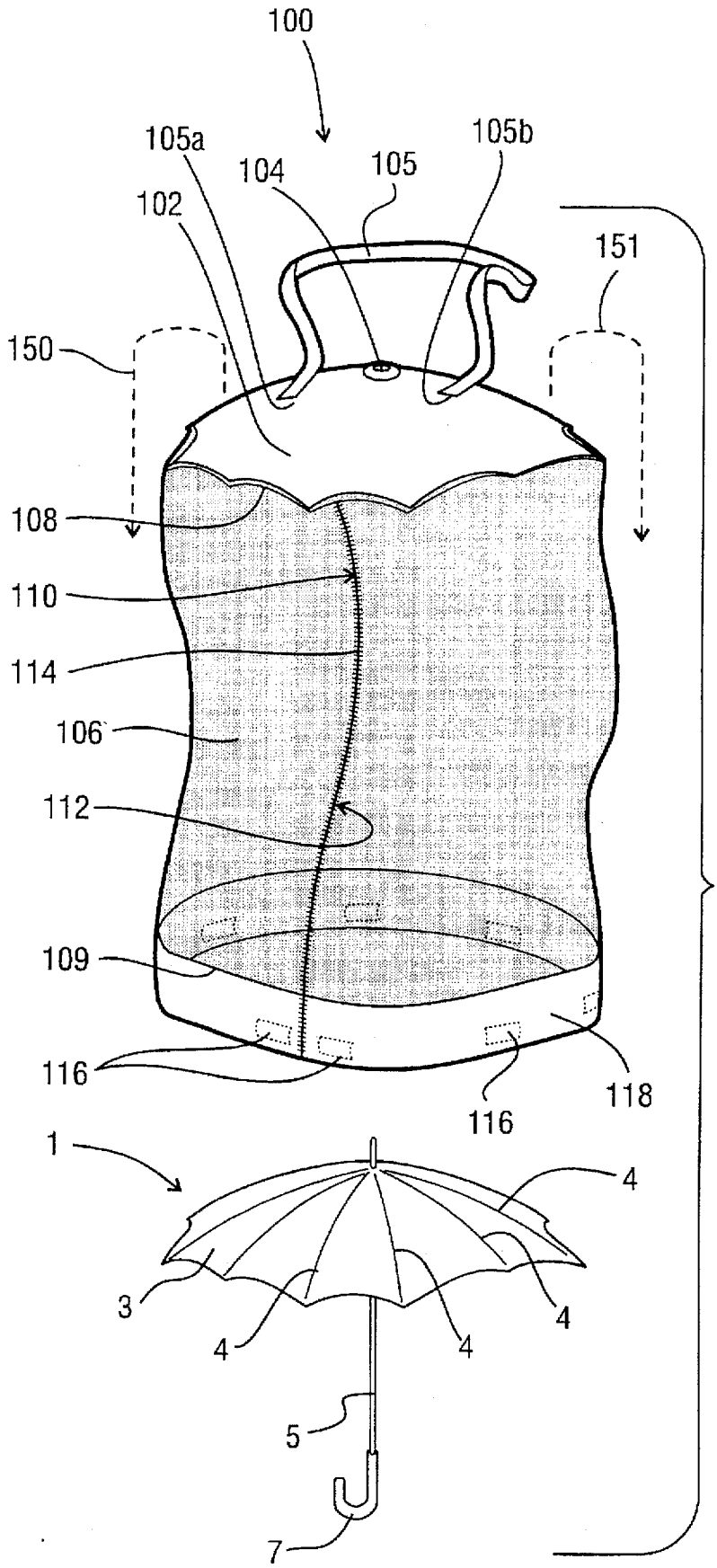
FIG. 1 is a perspective side view of a screen apparatus with a net-like material unrolled according to the present invention, shown positioned above a conventional umbrella prior to being placed atop the conventional umbrella for use.

Referring now to FIG. 1, a screen apparatus 100 is shown, according to the present invention, in a position above a conventional umbrella 1 prior to being placed atop the conventional umbrella for use. As is well-known, the conventional umbrella has an umbrella covering 3, which is substantially circular in shape and which is supported by a plurality of spokes 4 extending outwardly from an elongated supporting pole 5, which supports the plurality of spokes 4 at a fixed distance above a carrying handle 7 when the conventional umbrella 1 is being carried by a user 9 (see FIG. 4) in an open position.

The screen apparatus 100 has a supportive covering 102, preferably made of stiff molded plastic or other suitably stiff material. The covering 102 defines a relatively small circular opening 104, which is centrally positioned within the supportive covering 102 and which permits passage therethrough of the uppermost end of the conventional portable umbrella's supporting pole 5. The supportive covering 102 is relatively rigid, thereby to evenly distribute the weight of the screen apparatus 100 atop the plurality of spokes 4 which support the umbrella covering 3 of the conventional portable umbrella 1 in an open position. A preferred embodiment of the supportive covering 102 includes a carrying strap 105 with first and second ends 105a and **105*b* which are detachably affixed to the covering 102 in the proximity of the small circular opening 104** with snaps (not shown) or another manner well-known in the art.

A rectangular piece of a net-like material 106, such as mosquito-netting or other suitable material that permits air to pass therethrough while maintaining a protective tent-like enclosure that protects against flying insects passing therethrough, has an upper edge 108, a lower edge 109, a first side edge 110, and a second side edge 112. The net like material 106 is fashioned into a cylindrical shape by joining the first side edge 110 to the second side edge 112, preferably with a stitching 114 that will maintain the protective quality of the net-like material at the resulting seam. One skilled in the art will recognize that other suitable fastening means well-known in the art may be used to join the first side edge 110 to the second side edge 112.

The upper edge 108 of the net-like material 106 is fixedly attached, preferably with stitching or other fastening means well-known in the art, about the circumference of the supportive covering 102, thereby to define a continuous cylindrical sidewall of net-like material 106 about the circumference of the supportive covering 102. The net-like material 106 has a width sufficient to span the distance between the supportive covering 102 and the ground when the supportive covering is being carried atop the conventional portable umbrella 1 in the open position.

A preferred embodiment of the present invention fixedly attaches a plurality of weights 116 at predetermined locations about the lower edge 109, thereby to hasten the unrolling of the net-like material from a rolled position 202 (see FIG. 2) atop the supportive covering 102 in a direction toward the ground as shown by downward arrows 150 and 151, and, when the net-like material is unrolled, to retain the lower edge 109 in proximity to the ground.

Another preferred embodiment of the present invention attaches a skirt 118 about the lower edge 109 for preventing snagging and fraying of the lower edge 109 that otherwise may occur from dragging the lower edge 109 along the ground when the net-like material is unrolled. Preferably, the skirt 118 ranges between 1 inch and 3 inches in width and is manufactured of a nylon material, a plastic material, or other suitable protective flexible material that is well-known in the art. One skilled in the art will recognize that the skirt 118 may cover the plurality of weights 116 which are fixedly attached at predetermined locations about the lower edge 109. Alternatively, the plurality of weights 116 may be fixedly attached to the skirt 118, which is attached about the lower edge 109.

Figure 2:
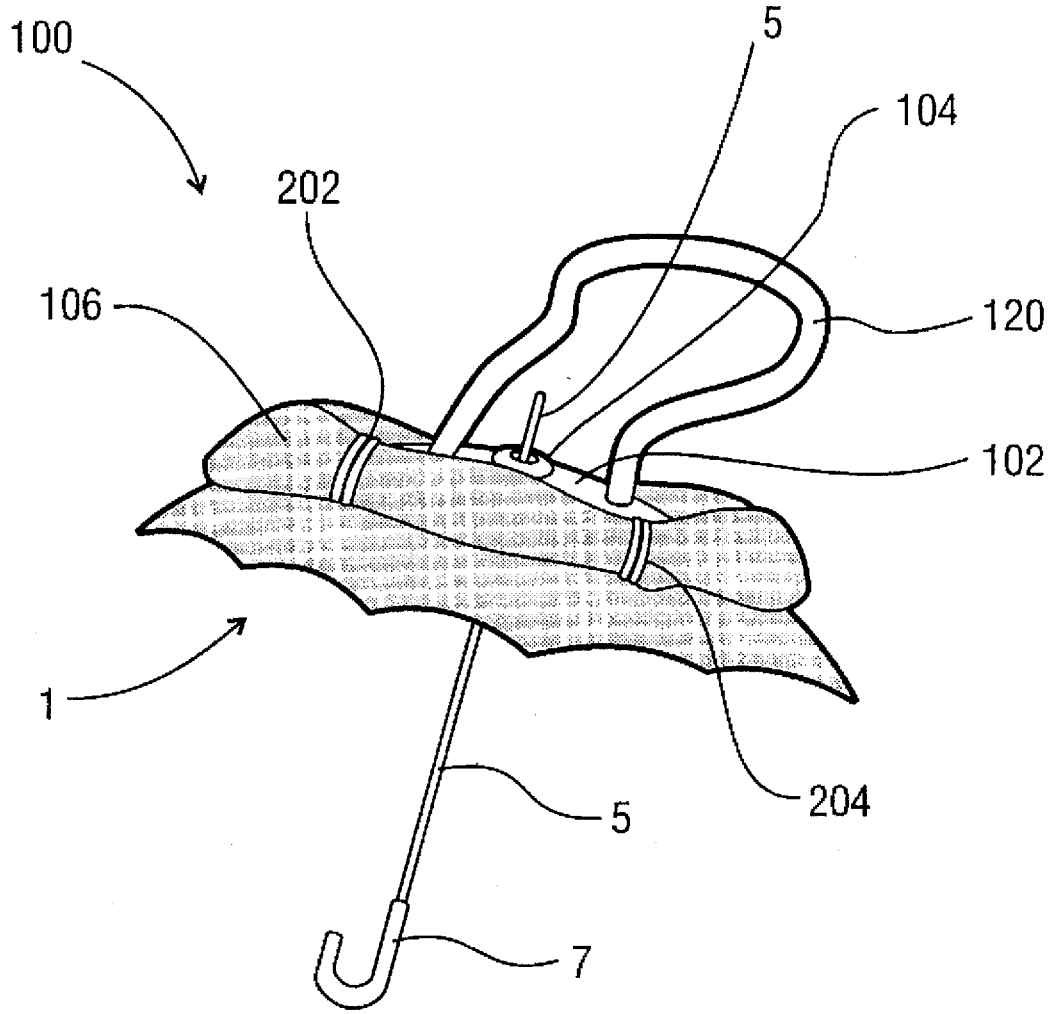
FIG. 2 is a perspective side view of the screen apparatus of FIG. 1 with the net-like material rolled for storage according to the present invention, shown positioned atop the conventional umbrella of FIG. 1 according to a preferred embodiment of the present invention.
Figure 3:
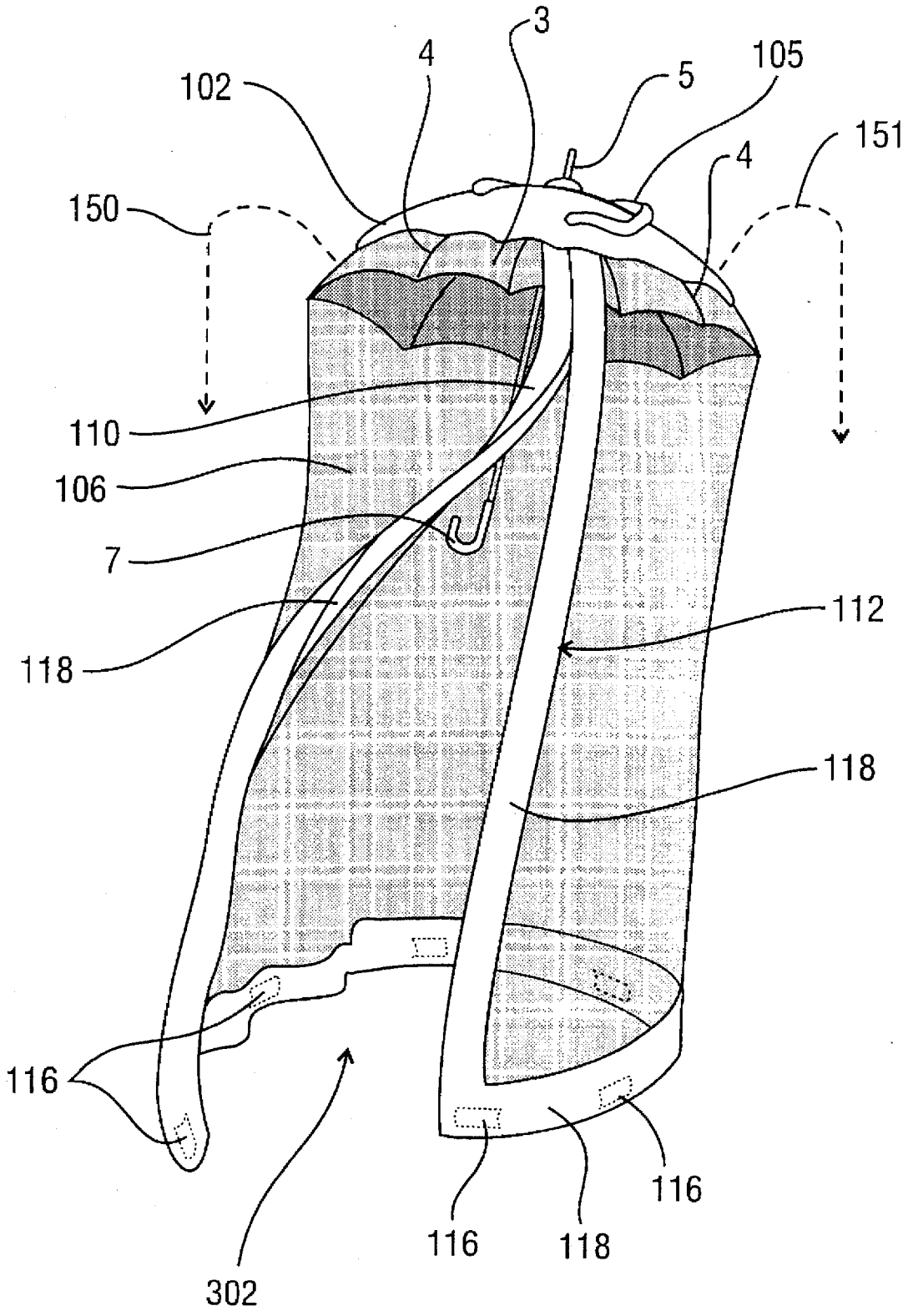
FIG. 3 is a preferred embodiment of the present invention with an overlapping drapery-type opening in the net-like material.

FIG. 2 shows the net-like material 106 rolled and secured atop the supportive covering 102, which rests atop the conventional portable umbrella 1 with the uppermost end of the supporting pole passing through the small circular opening 104. The net-like material 106 is secured atop the supportive covering with clips 202 and 204, which clamp the net-like material 106 in a rolled position atop the supportive covering 102. As previously described, the net-like material 106 is affixed about the circumference of the supportive covering 102; therefore, the net-like material is shown in FIG. 3 as trailing from the circumference of the supportive covering 102 to the rolled net-like material 106 at the clips 202 and 203. The clips 202 and 204 are easily removed in order to permit the net-like material to drop over the edge of the supportive covering 102 to the ground. Another preferred embodiment of the present invention uses straps, which are affixed to the supportive covering 102 in a manner well-known in the art, thereby to retain the net-like material 106 atop the supportive covering 102.

The umbrella covering 3 is not visible in FIG. 2 in accordance with a preferred embodiment of the present invention. The preferred embodiment provides that the supportive covering 102 has a circumference larger than the circumference of the umbrella covering 3, thereby to completely cover and to overhang the umbrella covering 3 when the supportive covering 102 is positioned atop the umbrella covering 3, as in FIG. 2. In this manner, the present invention provides an improved screen apparatus that overhangs the ends of the plurality of spokes 4 which commonly extend outwardly from the umbrella covering 3. When the net-like material 106 is unrolled, as in FIG. 1, the overhanging supportive covering 102 permits the net-like material 106 to hang from the supportive covering 102 uninfringed by the ends of the plurality of spokes 4 which would otherwise poke and snag the net-like material 106 that hangs from a differently sized supportive covering with a circumference smaller than the circumference of the umbrella covering 3 (see FIG. 3).

FIG. 3 shows a preferred embodiment of the present invention wherein the first side edge 110 is not joined to the second side edge 112 as in FIG. 1. Rather, the second side edge 112 and accompanying skirt 118 partially overlap the first side edge 110 and accompanying skirt 118 about the circumference of the supportive covering 102, thereby to define an overlapping drapery-type opening 302 through which a user may enter or exit the tent-like enclosure formed by the net-like material 106. The second side edge 112 overlaps the first side edge 110 along the distance to the ground in a manner well-known in the art, thereby to prevent flying insects from entering through the overlapping drapery-type opening 302. In this preferred embodiment, the skirt 118 is extended along the first side edge 110 and the second side edge 112, thereby to prevent snagging and fraying of the first side edge 110 and the second side edge 112 when a user (see FIG. 4) passes between the first side edge 110 and the second side edge upon entering or exiting the tent-like enclosure formed by the net-like material 106. Another preferred embodiment of the present invention attaches a zipper (not shown) along the first side edge 110 and the second side edge 112 over the distance to the ground in a manner well-known in the art, thereby to removably join the first side edge 110 to the second side edge 112 for additional protection against flying insects passing through the overlapping drapery-type opening 302. Alternatively, hook-and-loop fastening material may be used in the same manner as the zipper.

Note in FIG. 3 that the circumference of the supportive covering 102 is smaller than the circumference of the umbrella covering 3, thereby illustrating that the supportive covering 102 with a smaller circumference than that of the umbrella covering 3 is usable according to a preferred embodiment of the present invention. However, with this embodiment, the umbrella covering 3 and the plurality of spokes 4 is visible beneath the supportive covering 102. The net-like material 106, which is attached about the circumference of the supportive covering 102 as previously described, drapes over the umbrella covering 3 when unrolled, as shown in FIG. 3. Therefore, the present invention provides a screen apparatus which is interchangeably usable with various umbrellas having different sizes.

Figure 4:
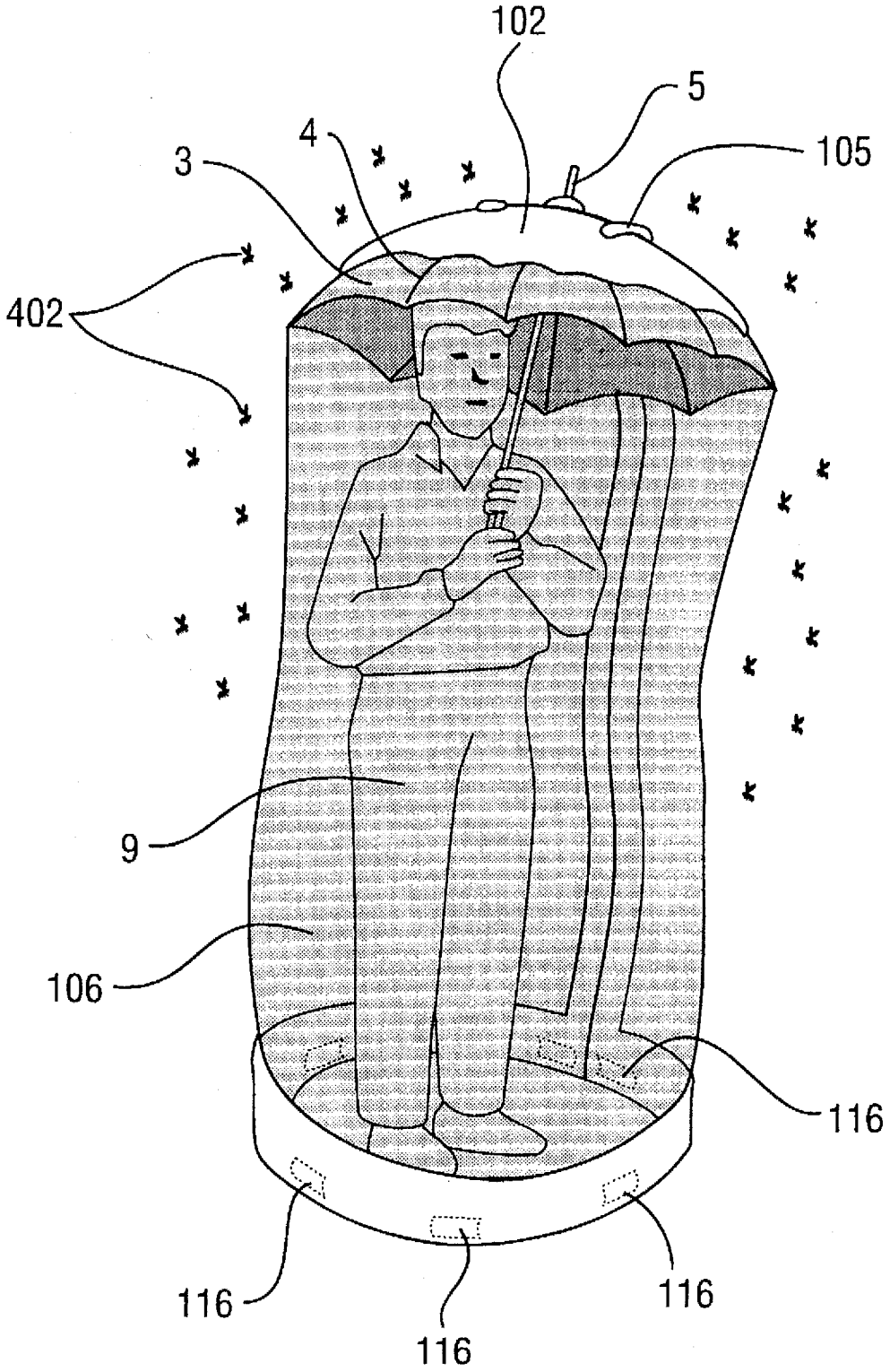
FIG. 4 shows a user within the tent-like enclosure formed by the present invention being protected from flying insects outside of the present invention.

FIG. 4 shows a user 9 within the tent-like enclosure formed by the present invention being protected from a plurality of flying insects 402 outside of the present invention.

2. Operation of the Preferred Embodiment

In use, the present invention is typically stored with the net-like material 106 rolled and clipped with clips 202, 204 on top of the supportive covering 102, as shown in FIG. 2. The screen apparatus 100 may be carried with the carrying strap 105 and positioned atop the conventional umbrella 1 in an open position to be unclipped and unrolled immediately when protection from flying insects is desired. Alternatively, the screen apparatus 100 may be carried atop the conventional portable umbrella 1 in an open position, thereby to be in a position for rapid unclipping and unrolling of the net-like material to the ground, thereby to form a tent-like enclosure from the supportive covering 102 over and around the user 9 who is holding the conventional portable umbrella 1.

To use the preferred embodiment of the present invention shown in FIG. 1, wherein the first side edge 110 is joined to the second side edge 112, the user 9 unclips and unrolls the net-like material 106 to the ground while the user is holding the carrying handle 7 and standing beneath the umbrella covering 3. Alternatively, the carrying handle 7 may be replaced by an extension rod (not shown) or telescopic pole (not shown) which extend to the ground, thereby to insert the extension rod into the ground for support of the screen apparatus 100 without holding the carrying handle 7. Of course, mobility through the plurality of flying insects 402 is restricted while the screen apparatus 100 is being supported by the extension rod in the ground.

To use the preferred embodiment of the present invention shown in FIG. 3, wherein the second side edge 112 overlaps the first side edge 110 to form the overlapping drapery-type opening, the user 9 may undip and unroll the net-like material 106 from outside of the umbrella 1 and then step within the tent-like enclosure formed by the unrolled net-like material 106. For additional protection, the user 9 may choose to zip the first side edge 110 together with the second side edge 112 in a preferred embodiment including a zipper as previously described. The user may also exit the tent-like enclosure through the same drapery-type opening. The user 9 who is protected within the tent-like enclosure of the screen apparatus 100 may walk carefully through a swarm of flying insects, such as a swarm of killer bees, being careful to retain the skirt 118 in close proximity to the ground, thereby to prevent the flying insects from entering the protective tent-like enclosure of the screen apparatus 100 from between the skirt 118 and the ground.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A screen apparatus adapted to form an enclosure when positioned atop an open umbrella, the screen apparatus comprising:

a stiff plastic supportive covering having a circumference and defining a centrally located opening adapted to permit passage there-through of an uppermost end of an elongated supporting pole of the umbrella, wherein the supportive covering is substantially rigid for evenly distributing the weight of the screen apparatus over spokes of the open umbrella wherein the supportive covering is dome shaped to conform to a top of the open umbrella;

a rectangular piece of netting having an upper edge, a lower edge, a first side edge and a second side edge, a length sufficient to circumvent the circumference of the supportive covering and a width adapted to sufficiently span the distance between the supportive covering and the ground when the supportive covering is positioned atop the open umbrella, the upper edge being fixedly attached about the circumference of the supportive covering, the first side edge along the width being joined to the second side edge along the width, thereby defining a cylinder about the circumference of the supportive covering;

a plurality of weights fixedly attached at predetermined locations about the lower edge; and wherein the lower edge with the plurality of weights is rollable toward the supportive covering and releasably securable atop the supportive covering for storage and subsequent release for unrolling toward the ground to form the enclosure beneath the supportive covering for protection from flying insects.

2. A screen apparatus adapted to form an enclosure when positioned atop an open umbrella, the screen apparatus comprising:

a stiff plastic supportive covering defining a centrally located opening adapted to permit passage therethrough of an uppermost end of an elongated supporting pole of the umbrella, wherein the supportive covering is substantially rigid for evenly distributing the weight of the screen apparatus over spokes of the open umbrella wherein the supportive covering is dome shaped to conform to a top of the open umbrella; and a net connected to the supportive covering and adapted to extend outward from the supportive covering along a cover of the open umbrella toward an outer circumferential edge of the cover, then downward toward the ground to form a cylindrical enclosure about a person positioned beneath the open umbrella, for protecting the person from flying insects.

* * * * *